United States Patent [19]

Labate et al.

[11] Patent Number: 4,687,184

[45] Date of Patent: Aug. 18, 1987

[54] DEVICE FOR INTRODUCING GAS INTO MOLTEN METAL IN A WIDE ANNULAR STREAM

[75] Inventors: Michael D. Labate, Ellwood City; Joseph A. Perri, Coraopolis, both of Pa.

[73] Assignee: Insul Company, Inc., East Palestine, Ohio

[21] Appl. No.: 885,158

[22] Filed: Jul. 14, 1986

[51] Int. Cl.[4] ..... C21C 5/48

[52] U.S. Cl. ..... 266/270; 266/265

[58] Field of Search ..... 266/220, 265, 266, 270, 266/218

[56] References Cited

U.S. PATENT DOCUMENTS

| | | | |
|---|---|---|---|
| 3,650,517 | 3/1972 | Messing | 266/220 |
| 3,834,685 | 9/1974 | Ziemkiewicz et al. | 266/220 |
| 4,053,147 | 10/1977 | Steg et al. | 266/220 |
| 4,396,179 | 8/1983 | LaBate | 266/220 |
| 4,462,576 | 7/1984 | Nohberg et al. | 266/220 |
| 4,481,809 | 11/1984 | LaBate | 73/86 |
| 4,483,520 | 11/1984 | LaBate | 266/220 |
| 4,538,795 | 9/1985 | LaBate | 266/220 |

FOREIGN PATENT DOCUMENTS

| | | | |
|---|---|---|---|
| 577247 | 6/1959 | Canada | 266/220 |
| 65904 | 3/1956 | France | 266/220 |

*Primary Examiner*—L. Dewayne Rutledge
*Assistant Examiner*—Robert L. McDowell
*Attorney, Agent, or Firm*—Harpman & Harpman

[57] ABSTRACT

A solid non-permeable refractory plug of an inverted frusto-conical shape has a spaced metal jacket and is located in an inverted frusto-conical shaped cavity in a pocket block incorporated in the normal refractory lining of a ladle to provide a structure through which gas can be introduced into the molten metal in an unusually large annular stream. A tubular body member is attached to the smaller lower end of the refractory plug and metal jacket and extends downwardly through the refractory lining of the ladle and an opening in the bottom of the ladle to which it is secured by a fastener and through which gas is introduced into the ladle. The large annular stream of gas formed by the device results in an improved stirring action in the molten metal and displaces molten metal that would otherwise tend to flow into the device and close the gas passageway. The device is inserted into the pocket block by moving it downwardly through the ladle and the pocket block.

10 Claims, 5 Drawing Figures

DEVICE FOR INTRODUCING GAS INTO MOLTEN METAL IN A WIDE ANNULAR STREAM

BACKGROUND OF THE INVENTION

1. Technical Field

This invention relates to device for insufflating gas into a mass of molten metal.

2. Description of the Prior Art

Prior structures of this type have generally employed frusto-conical permeable plugs positioned in frusto-conical cavities in pocket blocks in the refractory lining of the ladle. Typical devices may be seen in U.S. Pats. Nos. 3,834,685, 4,053,147 and 4,462,576. The LaBate prior art U.S. Pat. Nos. 4,396,179, 4,481,809, 4,483,520 and 4,538,795 disclose non-permeable refractory plugs of frusto-conical shape provided with metal jackets and positioned in frusto-conical cavities in pocket blocks. The LaBate pending application Ser. No. 06/769,143 illustrates a solid non-permeable refractory plug of frusto-conical shape with a spaced metal jacket positioned in a frusto-conical shaped cavity in a pocket block with the upper end of the plug and the jacket extending above the upper surface of the pocket block to form a hot metal dam.

The present invention substantially improves the stirring efficiency of gas introduced into molten metal and the metallurgical reactions that are responsive thereto due to the substantially increased area of the annular column of gas flowing upwardly through the molten metal which is achieved by the inverted frusto-conical shape of the solid plug, the metal shell thereon and the inverted frusto-conical shape of the cavity in the pocket block which very substantially enlarges the area of the device through which the gas enters the molten metal.

DESCRIPTION OF THE PREFERRED EMBODIMENT

Figure 1:
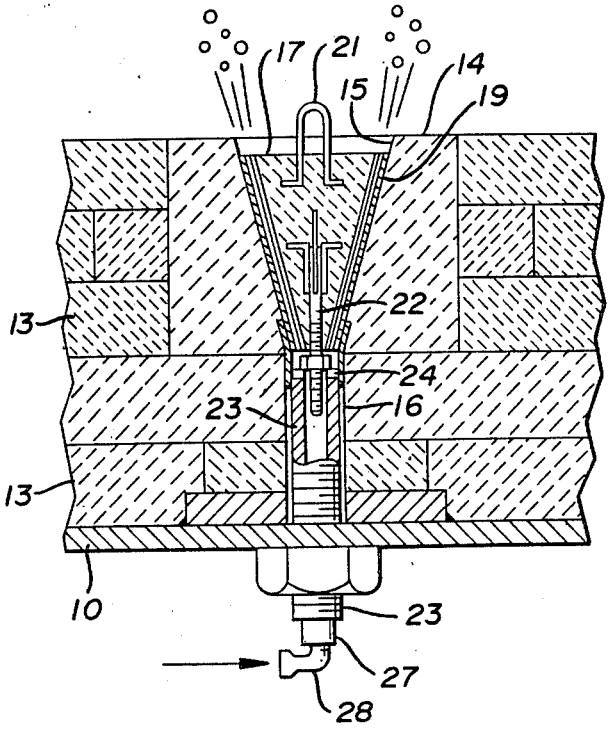
FIG. 1 is a vertical section through a portion of a hot metal ladle showing the device installed therein.
Figure 2:
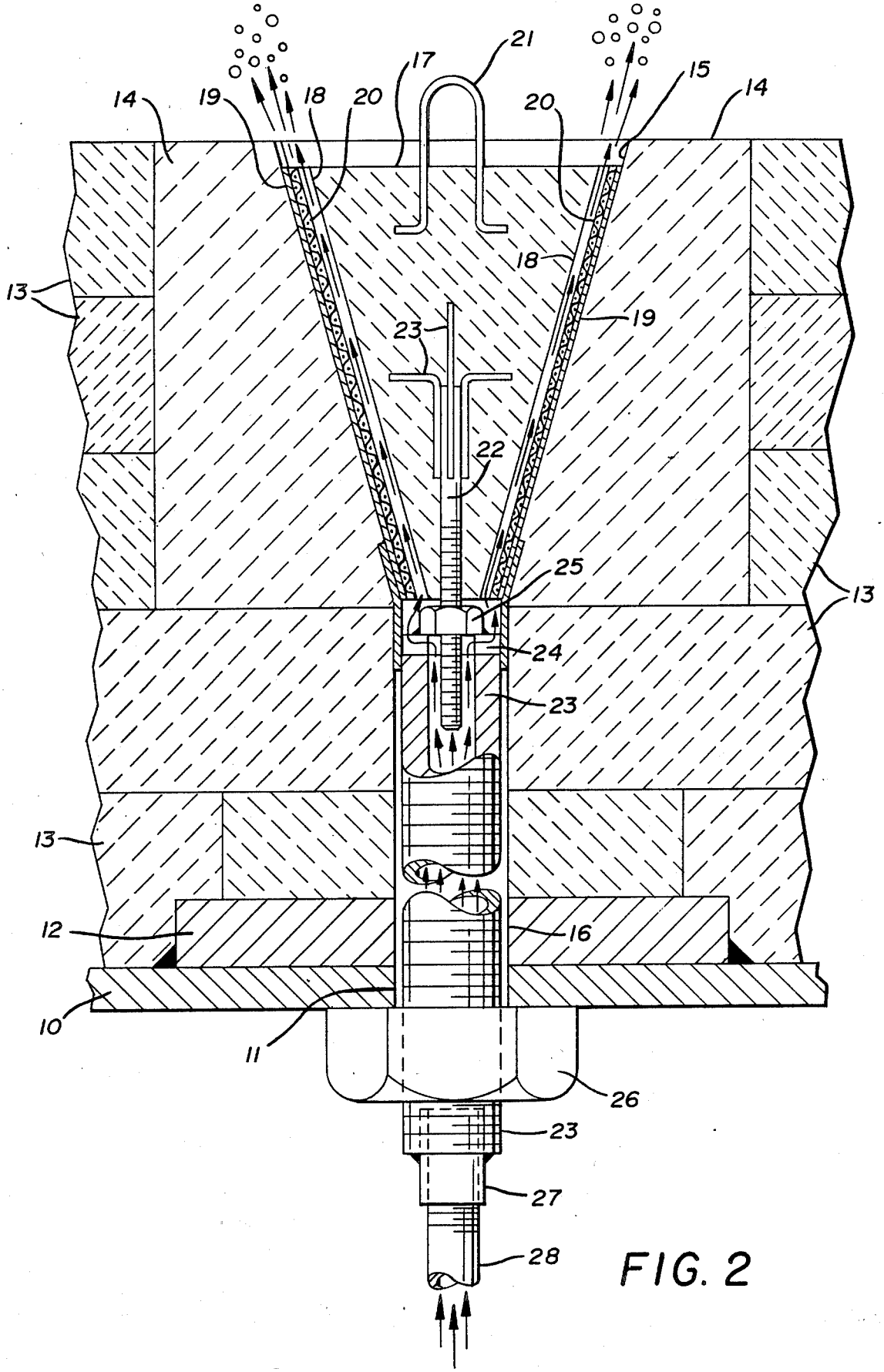
FIG. 2 is an enlarged vertical section through the device illustrating the gas passageways therethrough indicated by directional arrows.

In the form of the invention chosen for illustration herein, the device for introducing gas into molten metal in a wide annular stream is best illustrated in FIGS. 1 and 2 of the drawings wherein a bottom metal shell 10 of a ladle has an opening 11 therein and an apertured safety plate 12 secured to the ladle.10 in registry with the opening 11. Refractory bricks 13 form the usual refractory lining of the ladle and a pocket block 14 is positioned in the lining and surrounded by the refractory bricks 13 and/or rammed refractory as sometimes employed in hot metal ladle linings. The pocket block 14 has an inverted frustro-conical shaped cavity 15 therein. The diameter of the lower smaller end of the inverted frusto-conical cavity 15 compares with openings 16 in the refractory bricks 13, which openings are in vertical registry and are of the same diameter as the opening 11 in the bottom 10 of the ladle.

An inverted frusto-conical impervious plug 17 having longitudinally extending circumferentially spaced ribs 18 thereon spacing it from the metal or ceramic inverted frusto-conical shaped jacket 19 is positioned in the inverted frusto-conical shaped cavity 15 in the pocket block 14 so as to define an annular gas passageway through the pocket block 14. An inverted frusto-conical shaped stainless steel screen 20 is preferably positioned between the jacket 19 and the ribs 18 and/or the inverted frusto-conical shaped impervious plug 17.

The inverted frusto-conical impervious plug 17 is preferably precast of a suitable refractory and has a first generally U-shaped rod 21, the ends of the arms of which are outturned partially embedded therein to form a handle by which the device can be held and lowered into a ladle and positioned in the appropriate shaped pocket block 14. A bolt 22 having a head portion formed of steel rods 23, some of which are L-shaped, is partially embedded in the impervious plug 17 and extends outwardly of the lower end thereof as seen in FIGS. 1 and 2 of the drawings. A section of steel pipe 23 is attached to the external end of the bolt 22 by means of a transfer spider 24 attached to one end thereof and carrying a nut 25 which is attached thereto. The bolt 22 threadably engages the nut 25 and thus secures the impervious plug 17 to the pipe 23 which extends downwardly therefrom through the openings 16 in the refractory bricks 13 and through the safety plate 12 and the opening 11 in the ladle shell 10. A secondary nut 26 is threadably engaged on the lower threaded end of the steel pipe 23 and positioned in engagement with the shell 10 of the ladle and thus securely holds the device of the invention is desired position.

It will be observed that the construction is such that the pocket block 14 and the refractory bricks 13 or the like surrounding the same are held in desired position and the frequent cracking or separation of the refractory lining and/or the pocket blocks of the prior art is avoided which prevents damage to the refractory lining of the ladle as otherwise occurs from the entrance of hot metal into such cracks, openings and the like in the refractory lining adjacent the pocket block. The formation of the device also prevents the impervious plug 17 from being pushed away from the refractory lining and the pocket block and most importantly the upper end of the inverted frusto-conical impervious plug 17 in the inverted frusto-conical shaped cavity 15 provides an unusually large area against which pressure of molten steel serves to keep the impervious plug 17 as well as the pocket block 14 in tight position in the refractory lining of the ladle.

Still referring to FIGS. 1 and 2 of the drawings, it will be seen that the steel pipe 23 provides a gas passageway for a stirring gas, such as argon, and that at its lower end it is provided with an attached coupling 27 having an interior thread into which an argon gas line 28 is secured. The argon gas line 28 leads to a source of argon gas under suitable pressure as will be understood by those skilled in the art. Arrows indicating gas flow are present in FIG. 2 of the drawings showing the argon gas flowing upwardly through the device around the bolt 22 and into the area between the end of the pipe 23 and the spider 24 below the smaller end of the inverted frusto-conical shaped impervious plug 17 which provides space insuring a sufficient flow of gas into the annular passageway formed by the plug 17 and its spaced position with respect to the inverted frusto-conical shaped cavity 15 in the pocket block 14.

Figure 3:
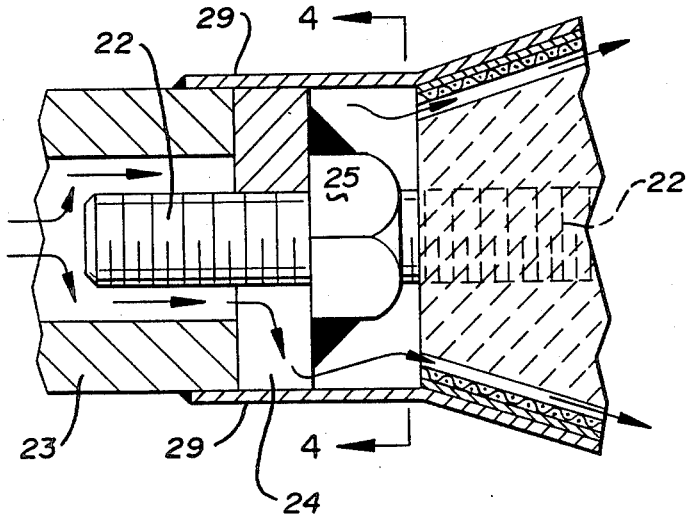
FIG. 3 is an enlarged transverse section of a portion of the device seen in FIG. 2 turned 90° therefrom.

In FIG. 3 of the drawings, an enlarged section of the upper end of the steel pipe 23, the spider 24 and the nut 24 threadably engaging the bolt 22 may be seen, the figure being turned 90° from vertical and it will be seen that a plurality of angular support arms 29 are attached as by welding it to the upper outer surface of the steel pipe 23 and extend alongside and are attached to the metal and/or ceramic jacket 19. Arrows in FIG. 3 illustrate the flow of argon gas or the like through the device and emphasize the area adjacent the small end of the inverted frusto-conical plug 17 which enables the gas to flow into the lower end of the circular passageway defined by the plug 17 and the cavity 15 in the pocket block 14 as hereinbefore described.

Figure 4:
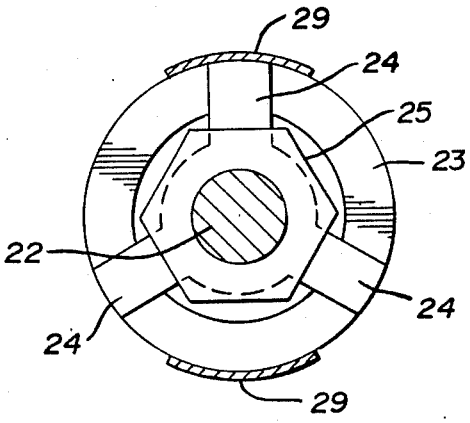
FIG. 4 is a cross section on line 4—4 of FIG. 3.

FIG. 4 is a section on line 4–4 of FIG. 3 and illustrates the upper end of the steel pipe 23, the spider 24, the nut 25 and the bolt 22 on which it is engaged.

Figure 5:
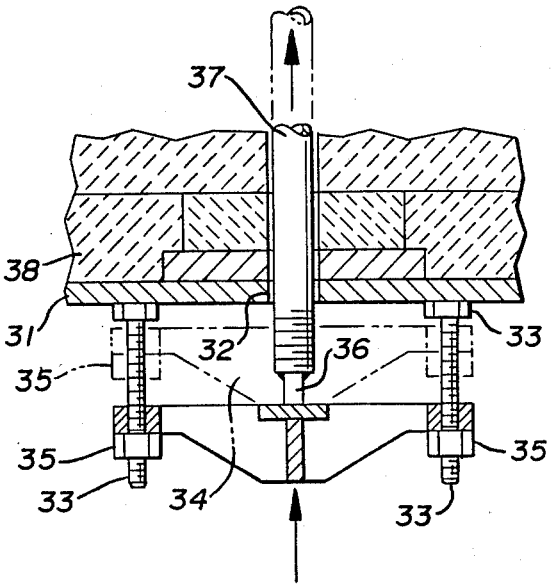
FIG. 5 is a vertical section with parts broken away illustrating an extractor for removing the device of the invention from a ladle.

It will occur to those skilled in the art that modifications of the device for introducing gas into molten metal in a wide annular stream can be made and in FIG. 5 a modification comprises means for removing the device from the ladle as illustrated in vertical section. In FIG. 5, the shell of a ladle 31 is apertured as at 32 and has a pair of bolts 33 attached thereto in depending relation. A bar 34 apertured at is ends is positioned between the bolts 33 and engaged thereon and nuts 35 on the bolts 33 will move the bar 34 from the lower position shown in solid lines in FIG. 5 to an upper position shown in broken lines and in doing so will engage a coupling 36 on the lower end of a steel pipe 37 which extends upwardly through the opening 32 and through the refractory 38 in the ladle and carries the device of the invention on its uppermost end. By moving the nuts 35 upwardly on the bolts 33 the upward movement of the bar 34 will thus forcibly push the device of the invention upwardly into the ladle and out of its normal seated engagement in the inverted frusto-conical cavity in the pocket block, all as illustrated in FIGS. 1 and 2 of the drawings and heretofore described and thus provide for the quick and easy removal of the device when it is eroded by molten steel and replaced. Replacement is made periodically when the device of the invention is eroded by the molten steel and the eroded device is simply removed from the ladle after being pushed upwardly into the same as just described. A replacement device including a new assembly of the inverted frusto-conical impervious pipe, the pipe depending therefrom, etc. is then positioned over the ladle by a suitable support and lowered thereinto and pushed downwardly into the pocket block 14, the bar 34 having been removed so as to permit the reinstallation of the secondary nut 26 which holds the device in position and the reattachment of the argon gas supply line 28 as will be understood by those skilled in the art.

In a working example of the invention, the area of the upper end of the refractory plug and jacket is at least three times as large as the lower end thereof such as 7½" at said upper end and 2" at the lower end, with the cavity in the pocket block slightly larger.

It will thus be seen that a device for introducing gas into molten metal in a wide annular stream has been disclosed, the device being capable of a substantially increased stirring action by the creation of a wide annular gas stream as compared with the prior art devices and incorporating fastening means insuring the positioning and retention of the device in the ladle or other hot metal vessel in which it may be installed.

Although but one embodiiment of the present invention has been illustrated and described, it will be apparent to those skilled in the art that various changes and modifications may be made therein without departing from the spirit of the invention and having thus described our invention, what we claim is:

1. In a device for introducing gas into a mass of molten metal, the improvement which comprises a refractory plug and a jacket positioned thereabout in spaced relation thereto and defining an opening around said refractory plug, said refractory plug and jacket having an upper end and a lower end with said upper end being substantially larger than said lower end, a pocket block having a passageway extending vertically therethrough, said passageway being substantially larger at its upper end than at its lower end, said pocket block adapted to form a portion of a refractory lining in a container for said molten metal, said container and refractory lining having an opening therein in registry with said passageway in said pocket block, said plug and said jacket positioned in said passageway in said pocket block and means in said opening in said container and refractory lining attached to said plug and jacket and extending outwardly of said opening in said container and secured to said container, said means defining a passageway for gas introduced thereinto whereby said gas introduced into said passageway will flow upwardly between said plug and said jacket into said molten metal in said container.

2. The device for introducing gas into a mass of molten metal set forth in claim 1 and wherein said refractory plug is impervious, means positioned between said refractory plug and said jacket positioning said jacket in evenly spaced relation to said refractory plug.

3. The device for introducing gas into a mass of molten metal set forth in claim 1 and wherein said refractory plug and jacket are cross sectionally circular and said passageway extending through said pocket block is cross sectionally circular.

4. The device for introducing gas into a mass of molten metal set forth in claim 1 and wherein said refractory plug and jacket are of an inverted frusto-conical shape and said passageway in said pocket block is an inverted frusto-conical shape.

5. The device for introducing gas into a mass of molten metal set forth in claim 1 and wherein said means in said opening in said container and refractory lining attached to said plug and jacket and secured to said container comprising a tubular member, an element on one end of said tubular member and an elongated member engaged in said element and partially embedded in said refractory plug.

6. The device for introducing gas into a mass of molten metal set forth in claim 5 and wherein a thread pattern is formed on one end of said tubular member extending outwardly of said opening in said container and a nut is threaded on said thread pattern to a position engaging said container around said opening therein.

7. The device for introducing gas into a mass of molten metal set forth in claim 5 and wherein said element on one end of said elongated member is a spider having an interiorly threaded opening therethrough and said elongated member is a bolt having its head portion embedded in said plug.

8. The device for introducing gas into a mass of molten metal set forth in claim 2 and wherein said means positioning said plug and jacket in evenly spaced relation comprises a plurality of ribs formed on said plug in circumferentially spaced relation.

9. The device for introducing gas into a mass of molten metal set forth in claim 2 and wherein said means positioned between said plug and said jacket for evenly spacing the same comprises stainless steel screen.

10. The device for introducing gas into a mass of molten metal set forth in claim 1 and wherein said refractory plug and jacket positioned thereabout are of an inverted frusto-conical shape and the passageway extending vertically through said pocket block is of inverted frusto-conical shape, said lower end of said inverted frusto-conical shaped plug and jacket being of a first diameter and said upper end of said inverted frusto-conical shaped plug and jacket being of a second diameter at least three times as large as said first diameter of said lower end of said inverted frusto-conical shaped plug and jacket whereby said gas is introduced into said mass of molten metal in an annular pattern of a diameter at least as great as the first diameter of said upper end of said frusto-conical shaped plug and jacket.

* * * * *